United States Patent [19]

Rudy

[11] 4,271,606

[45] Jun. 9, 1981

[54] SHOES WITH STUDDED SOLES

[75] Inventor: Marion F. Rudy, Northridge, Calif.

[73] Assignee: Robert C. Bogert, Woodland Hills, Calif.

[21] Appl. No.: 84,879

[22] Filed: Oct. 15, 1979

[51] Int. Cl.[3] ..... A43B 13/20; A43B 13/04; A43B 23/28

[52] U.S. Cl. ..... 36/29; 36/32 R; 36/59 C

[58] Field of Search ..... 36/28, 29, 59 C, 32 R, 36/35 R, 35 B, 71, 88, 93, 96, 43, 44; 264/299, 230, 234, 319; 128/90, 382, 383; 2/2.5, 413, 414, DIG. 3, DIG. 10

[56] References Cited

U.S. PATENT DOCUMENTS

| | | | |
|---|---|---|---|
| 2,189,813 | 2/1940 | McGuire | 36/29 |
| 2,739,093 | 3/1956 | Bull | 36/29 |
| 3,005,272 | 10/1961 | Shelare et al. | 36/29 |
| 4,085,527 | 4/1978 | Riggs | 36/59 C |

FOREIGN PATENT DOCUMENTS

| | | | |
|---|---|---|---|
| 692881 | 5/1940 | Fed. Rep. of Germany | 36/29 |
| 941123 | 2/1949 | France | 36/29 |

*Primary Examiner*—Patrick D. Lawson
*Attorney, Agent, or Firm*—Subkow and Kriegel

[57] ABSTRACT

Shoes incorporating a multiple chambered sole member inflated to a pressure above atmospheric, and disposed above and adjacent to an outsole having a deflectable web and projecting elements, such as ground-engaging studs, depending from the web and disposed in spaced geometric relation to each other to distribute loads imposed on the studs through a greater area of the inflated sole member to a wearer's foot, thereby enhancing its support and comfort.

17 Claims, 15 Drawing Figures

SHOES WITH STUDDED SOLES

The present invention relates to shoes, and more particularly to shoes embodying an outsole having spaced studs, ribs, and similar projections, providing traction against the ground. A shoe of this type is disclosed in U.S. Pat. No. 3,793,750, patented Feb. 26, 1974. The specific shoe illustrated therein is particularly designed for use as athletic footwear, such as football shoes.

While the shoe disclosed in the patent represents an advance in the art, there are disadvantages associated with its design. The greatly increased compression and shear loading between the load bearing surfaces of the studs or ribs and the ground has resulted in excessively rapid wear of the outsole. Only a relatively small numbers of the studs or rib elements are in contact with the ground at any one time, resulting in unusually high and damaging loads on the studs, which greatly accelerates the wear on the most heavily loaded stud or rib areas.

An object of the present invention is to provide a shoe having an outsole embodying ground engaging studs or ribs which have a greatly extended wear life.

Another object of the invention is to provide a shoe embodying a studded or ribbed outsole that coacts with other sole portions of the shoe to produce improved shock absorption, and produce reduced weight, improved traction with the ground, and which distributes concentrated loads on one or more of the studs or ribs over a significantly greater area of the sole portion of the shoe, to achieve extended outsole wear and improvement in the efficiency of activities, such as walking, running and jumping.

In general, the invention includes the combination of an outsole, having ground engaging studs or ribs, and a pneumatically inflated insole, such as disclosed in applicant's application, Ser. No. 830,589, filed Sept. 6, 1977, on "Improved Insole Construction For Articles Of Footwear", now U.S. Pat. No. 4,183,156 and application, Ser. No. 918,790, filed June 26, 1978, for "Footwear". The studs or ribs, or other ground engaging elements, are secured to a thin elastically deformable supporting membrane or web which transmits the load imposed on a stud or studs to a multiplicity of fluid chambers, or other elements of a pneumatic insole, so that the most highly loaded individual stud or studs automatically recede into the pneumatic pressurized midsole, bringing a larger number of the studs or elements into load bearing contact with the ground, until a balance is achieved between the applied load to the studs and the working fluid pressure within the pneumatic insole. The pressurized insole chambers act effectively to balance and redistribute localized forces on a single stud, and average this force over many of the ground engaging or traction elements in any particular instant.

A further object of the invention is to provide a shoe having studs, in which their traction is improved with the load bearing wear surface of each stud in relatively flat engagement with the ground. Shear forces between the ground and the stud cause the latter to tip, as permitted by the outsole interconnecting web, instantly changing the stud or studs from flat engagement with the ground to a plurality of edges that bite into the ground and substantially increase the frictional force between the ground and the shoe.

Still another objective of the invention is to provide a softer, greater shock absorbing, composite spring system between the foot and the ground, which results from the loading imposed on the underside of the pneumatic midsole by the depending studs or ribs, and the equal and opposite force of the load bearing area of the foot pushing downwardly on the upper side of the pneumatic midsole.

This invention possesses many other advantages, and has other objects which may be made more clearly apparent from a consideration of several forms in which it may be embodied. Such forms are shown in the drawings accompanying and forming part of the present specification. These forms will now be described in detail for the purpose of illustrating the general principles of the invention; but it is to be understood that such detailed description is not to be taken in a limiting sense.

Referring to the drawings.

Figure 2:
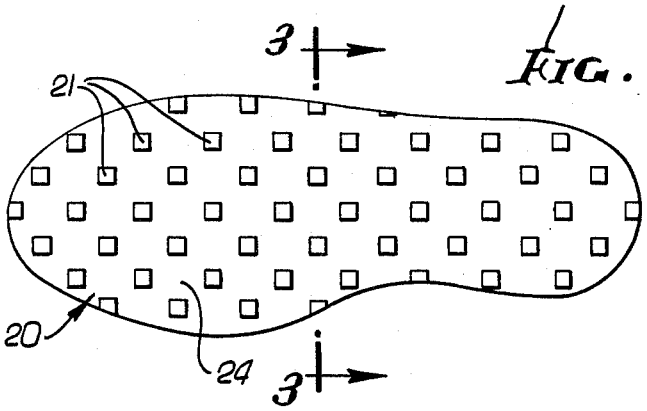
FIG. 2 is a bottom plan view of the shoe disclosing its outsole portion.
Figure 3:
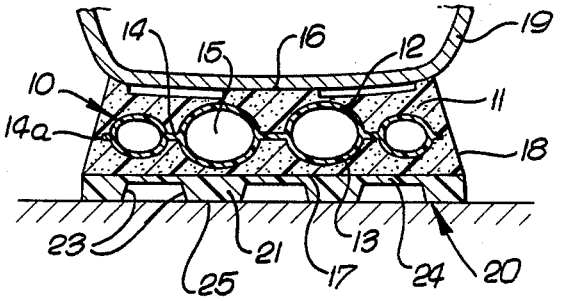
FIG. 3 is an enlarged cross-section taken on the line 3—3 on FIG. 2, disclosing the composite sole of the shoe under a no-load condition.
Figure 4:
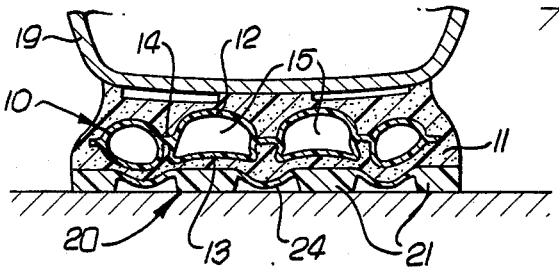
FIG. 4 is a view similar to FIG. 3 disclosing the interaction between the outsole and the midsole under a medium load condition.
Figure 5:
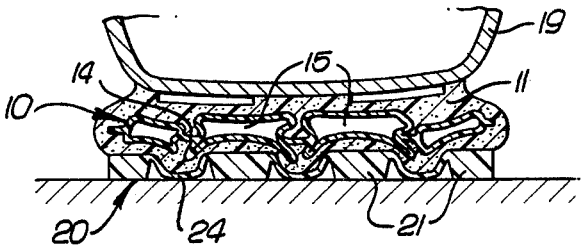
FIG. 5 is a view similar to FIGS. 3 and 4 disclosing the outsole and midsole under a heavy load condition.
Figure 6:
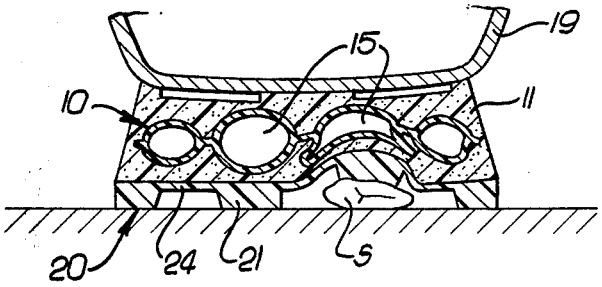
Figure 7:
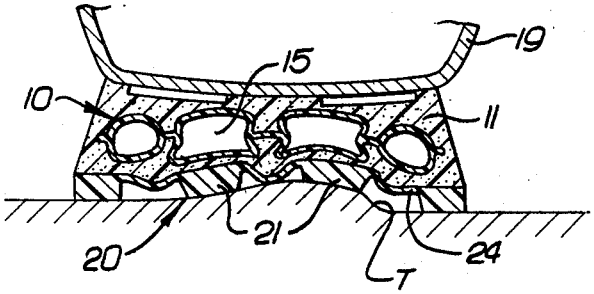
Figure 8:
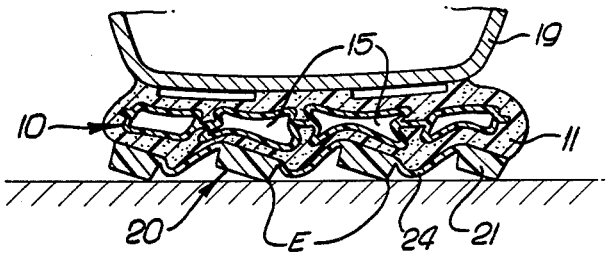
Figure 9:
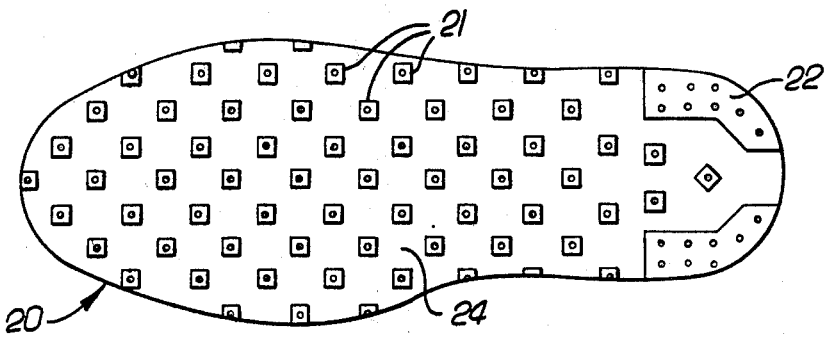
Figure 10:
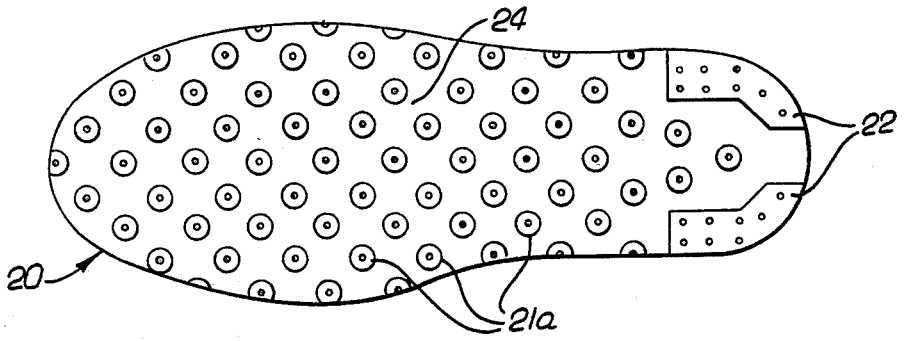
Figure 11:
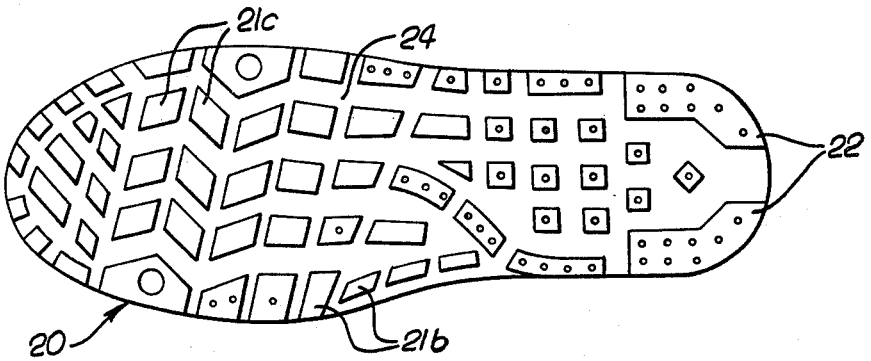
Figure 12:
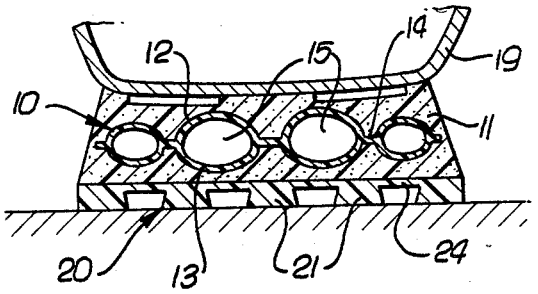
Figure 13:
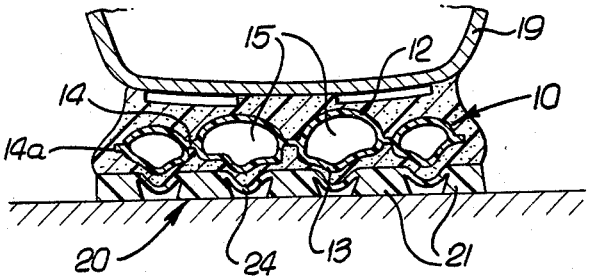
Figure 14:
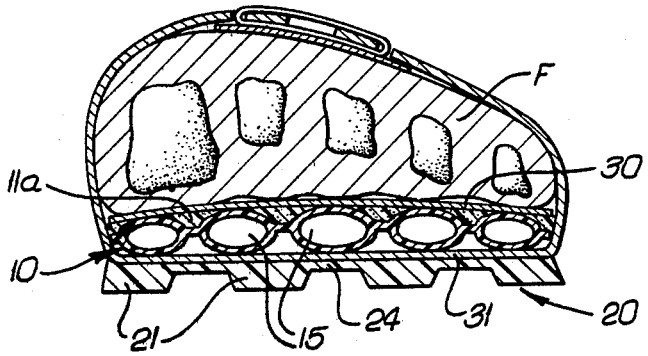
Figure 15:
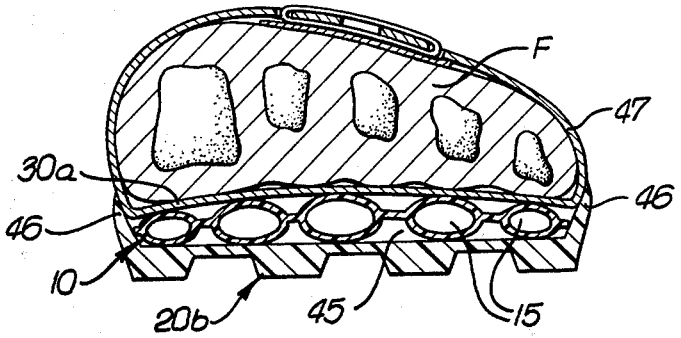

FIG. 6 discloses the midsole and outsole when a small region of the outsole is subjected to a concentrated load, such as provided by stepping on a stone resting on the ground;

FIG. 7 is a view similar to FIGS. 3 and 6, inclusive, showing the positions assumed by the outsole and midsole when the outsole is bearing against an irregular terrain;

FIG. 8 is a view similar to FIG. 3 disclosing the relative relationship between the midsole and the outsole when the shoe is subjected to shear forces, illustrating the tilting of the studs with respect to the ground;

FIG. 9 is a bottom hand plan view of a modified form of outsole having a different pattern of depending studs and depending heel supporting segments;

FIG. 10 is a bottom plan view of yet another embodiment of an outsole having circular or cylindrical studs and heel segments;

FIG. 11 is a view similar to FIG. 2 of an outsole having a different pattern of ground engaging studs;

FIG. 12 is a view similar to FIG. 3 disclosing depending studs bearing a different specific relation with respect to the pneumatic chambers of the midsole thereabove, the shoe being under a no-load condition;

FIG. 13 is a view similar to FIG. 12 disclosing the outsole and midsole under a loaded condition;

FIG. 14 is a cross-section, corresponding to FIG. 3, of yet another embodiment of the invention, with a pneumatic sole member functioning as an insole inside the lasted configuration of the shoe; and FIG. 15 is a view of yet another embodiment of the invention, similar to FIG. 3, disclosing the pneumatically inflated member positioned to function as a midsole outside the lasted configuration of the shoe.

As shown in FIGS. 1 to 8, inclusive, an inflated insert 10 is encapsulated in an elastomeric and permeable foam 11 to provide a midsole of a shoe, as disclosed in applicant's U.S. application Ser. No. 918,790. The inflated insert comprises two layers 12, 13 of a thin-walled, highly stressed elastomeric material whose outer perimeter generally conforms to the outline of the human foot. The two layers are sealed and welded to one another (e.g. welded, as by a radio frequency welding operation) around the outer periphery 14*a* thereof and are also welded to one another along weld lines 14 to form a multiplicity of intercommunicating tubular sealed chambers 15 preferably inflated with a gas, such as sulfur hexafluoride.

The insert 10 is inflated by puncturing one of the chambers with a hollow needle through which the inflating gas is introduced, until the desired pressure in the chambers is reached, after which the needle is withdrawn and the puncture formed thereby sealed. The inflation medium may be a large molecule gas or a mixture of the gas and air or air alone, although it is preferred to use the large molecule gas. When one or a combination of special gases are used, it is found that the pressure in the chambers increases at first to a level higher than the initial inflation pressure, and then gradually decreases. The pressure increase is due to diffusion-pumping (reverse diffusion) of air into the insert. The effective inflated life of the insert can be as high as five years when such diffusion pumping of air occurs. When air is used to provide a portion of the inflation pressure of the insert, its inflated life is also extended by virtue of the fact that such air cannot normally diffuse out because the internal pressure of the air is in equilibrium with the pressure of the outside ambient air. Such internal air can be introduced into the system either by the mechanism of diffusion pumping, which is preferable, or by initially inflating the insert with a mixture of air and the special large molecule gas.

As disclosed in FIGS. 1 to 8, inclusive, and as described in U.S. application Ser. No. 918,790, the inflated insole or insert is encapsulated in a foam within a suitable mold (not shown), the foam material being elastomeric and permeable. The inflated insole is appropriately positioned within the mold with the required space provided around the insole. An uncured liquid polymer, catalyst and foaming agent are injected into the mold cavity, the foamed elastomeric material expanding to fill the space between the insole or insert and the mold walls. The foam material is allowed to cure and bond to the insole, resulting in upper and lower substantially flat surfaces 16, 17 and side surfaces 18 of the encapsulating material.

The insert or insole 10 and the foam encapsulating material 11 surrounding it are used as the midsole of a shoe, a shoe upper 19 being cemented thereto. A tread or outsole 20 is suitably affixed to the bottom 17 of the midsole.

The particular material from which the insert 10 may be made and the type of gases that may be used for inflating the chambers 15 are set forth in application Ser. No. 830,589 (now U.S. Pat. No. 4,183,156). One of the materials found to be particularly useful in manufacturing an insulated insert is a polyurethane film. The two most desirable gases for use in inflating the insert are hexafluoromethane and sulfur hexafluoride. The most satisfactory of elastic foam materials have been found to be the polyurethanes, ethylenevinylacetate/polyethylene copolymer, ethylenevinylacetate/polypropylene copolymer, neoprene and polyester.

The foam encapsulating member 11 is permeable to air, thus allowing the ambient air to pass therethrough and through the material of the insert 10 into the chambers 15, to enhance the fluid pressure therein, and prevent the fluid pressure from decreasing below its useful value, except after the passage of a substantial number of years.

Figure 1:
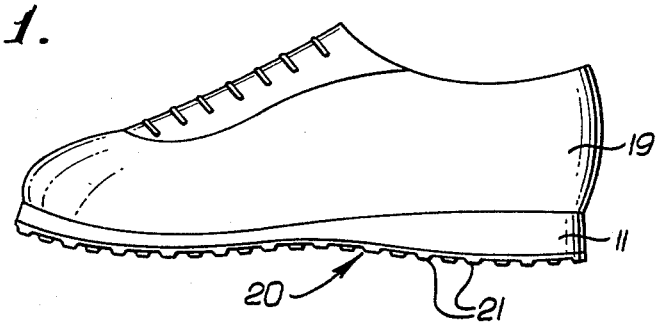
FIG. 1 is a side elevational view of a shoe embodying the invention.

The chambers 15 preferably extend longitudinally of the midsole and intercommunicate, as shown in FIG. 1 of patent application Ser. No. 918,790. The outer sole 20 includes ground engaging studs 21 spaced with respect to each other and having the pattern illustrated in FIG. 9, except there are segmental inserts 22 at the heel portion of the shoe. These studs have slightly tapered sides 23 and are integral with a thin interconnecting elastically deformable supporting membrane or web 24 which is suitably cemented to the lower side of the encapsulating foam, with the lower surfaces 25 of the studs and segments 22 being flat and capable of engaging the ground surface.

The thickness of the web 24 may be from about 0.015" to about 0.080", and preferably about 0.020", which will permit it to deform and allow each stud 21 to shift relative to other studs, and relative to the foam encapsulating material 11 and the pneumatic sole member 10.

These studs and segments are made of wear resistant and durable material, such as polyurethane, thermal plastic rubber, natural rubber, SBR rubber, neoprene rubber, and the like.

As specifically disclosed in FIGS. 3 to 8, inclusive, the studs underlie the chambers 15 which extend lengthwise of the midsole. When a light downward load is imposed upon the shoe, forcing the studs 21 and segments 22 against the ground surface, the studs are pressed relatively upwardly, to deform the foam member 11 and the chambers 15 (FIG. 4), the relatively rigid studs automatically receding into the pressurized midsole, thus bringing a large number of studs 21, and like elements, into load bearing contact with the ground, until a balance is achieved between the applied load to the studs and working fluid pressure within the pneumatic chambers 15. The pressurized chambers act effectively to balance and redistribute a localized force on a single stud and average this force over all of the studs in load bearing contact with the ground in any particular instant.

Under medium to heavy loads on the shoe, the studs 21 recess into and toward the pressurized chambers 15, decreasing the volume therein and proportionately increasing the supporting fluid pressure therein. Under these conditions, the fluid chambers are distorted and a portion of this fluid pressure is applied across the thin interconnecting web 24, causing it to move into load bearing contact with the ground, as shown in the heavy load condition illustrated in FIG. 5. This greatly increases the load bearing area of the outsole 20 and proportionately reduces the unit loading on the outsole wear surfaces 25. Accordingly, reductions in the wear surface loading results in disproportionate increase in the wear life of the outsole. Tests have shown that the wear life of the outsole increases 25% to over 100%, using identical outsole materials, stud sizes, shapes and geometric patterns.

The condition illustrated in FIG. 6 is an extreme one, in which there is a concentrated load applied to one of the studs, as by a stone S. The total force imposed on the stud engaging the stone will be transmitted through the flexible foam material 11 and through the pressurized fluid in the chambers 15, and from chamber to chamber, for distribution to other ground engaging studs. Similarly, when the shoe is engaging an irregular terrain T, as shown in FIG. 7, the relatively heavy load imposed on several of the studs will be transferred to the pressurized chambers 15 and to other studs 21, to force them downwardly against the ground, thereby sharing the load with the studs pressed inwardly by the irregular terrain.

Another advantage of the combination disclosed is in increasing the traction of the studs 21 against the ground. When the load bearing wear surface on the studs is flat against the ground, shear forces between the ground and each stud causes the stud to tip in an amount proportional to the shear force, changing the stud position from a flat surface-to-surface contact with the ground to an edge E that bites into the ground and substantially increases the friction force between the ground and the shoe.

Another stud pattern and segment arrangement is illustrated in FIG. 10, in which the studs 21*a* are spaced with respect to one another in a desired pattern, and in which the studs are of generally cylindrical shape. Yet another pattern is illustrated in FIG. 11, in which the studs 21*b* are of polygonal shape and are so positioned as to generally follow the path of the chambers 15 disposed in the midsole. As an example, the zig-zag chambered portions shown in FIG. 1 of application Ser. No. 918,790 would be disposed above the zig-zag or herringbone arrangement of the studs 21*c* shown in FIG. 11.

In the form of invention illustrated in FIGS. 12 and 13, in lieu of the studs being disposed directly under the chambers, as in FIG. 3, they are located to one side of or offset with respect to the elongate chambers 15. FIG. 12 illustrates the outsole and midsole arrangement with the shoe under a no-load condition, whereas FIG. 13 discloses the shoe under a load condition, from which it is seen that the studs will still recede into the pneumatic pressurized midsole, the force being distributed to the pneumatic midsole, from where it is transferred to a large number of other studs brought into load bearing contact with the ground.

In the form of invention illustrated in FIG. 14, a foot F is disclosed within a shoe, resting on a semi-flexible moderator 30 that bears against an insert 10 encapsulated over its upper portion with a permeable foam 11*a*. The lower portion of the insert rests upon the bottom portion 31 of the lasted configuration of the shoe, a studded outsole 20 being suitably cemented to this bottom portion, the outsole having a thin web 24 integral with the studs 21.

In the form of the invention disclosed in FIG. 15, the foot F is disposed in a shoe, resting upon the bottom 30*a* of the lasted configuration of the shoe, an insole or insert 10 being disposed within a cavity 45 in an outsole 20*b* which has its side portions 46 extending upwardly and overlapping a shoe upper 47, to which it is suitably secured, as by cementing. The bottom or moderator portion 30*a* of the shoe bridges the spaces between the tubular chambers 15 to transfer the load between the foot F and the insert 10. This insert functions as a midsole in the configuration illustrated in FIG. 15.

In FIG. 14, the moderator 30 may not be required where the upper foam member 11*a* is employed, but can be used in the absence of the upper foam member, so as to bridge the spaces between the longitudinally extending chambers, the insert itself functioning as an insole within the shoe.

Because of the use of the relatively thin web 24 and the inflated insert or sole member 10, the weight of the shoe is decreased. The distribution of the load between studs 21 through the intervention of the encapsulating member 11 and the pneumatic insert 10 results in the wear life of the shoe being increased considerably, the improvement being from about 25% to over 100%, as noted above. In addition, the combination of the interaction between the foot F and the inflatable chambers 15 and between the inflatable chambers and the studs 21, permitted by the thin web 24, enhances the cushioning action on the foot, resulting in a softer feel and greater shock absorbing than a relatively thick outsole possessing a conventional tread. Most of the shock absorbing spring action between the foot and the ground occurs by virtue of the foot elastically deflecting the air-foam midsole.

The inventor claims:

1. A structure adapted to form part of a shoe for receiving a person's foot, comprising a sealed sole member of elastomeric material providing a plurality of deformable intercommunicating chambers adapted to be inflated with a gaseous medium under pressure, an outer sole including a thin elastic deflectable web portion underlying and in load transmitting relation to said sole member and ground engaging studs spaced substantially from each other transversely of the outer sole and longitudinally of the outer sole and secured to and depending from said web portion, said web portion having a thickness of from about 0.015 inches to 0.080 inches, whereby said studs are shiftable with respect to each other and with respect to said deflectable web portion and sole member in transmitting loads between the person's foot and the ground engaged by said studs.

2. A structure as defined in claim 1; an elastomeric outer deformable member encapsulating at least the upper portion of said sole member.

3. A structure as defined in claim 1; an elastomeric outer deformable member surrounding and fully encapsulating said sole member, and means securing said web to the underside of said elastomeric outer member.

4. A structure as defined in claim 1; some of said studs underlying some of said chambers.

5. A structure as defined in claim 1; some of said studs being displaced from vertical alignment with respect to some of said chambers.

6. A structure as defined in claim 1; the lower portion of said sole member bearing against said web.

7. A structure as defined in claim 1; said outer sole having a cavity, said sole member being disposed in said cavity and bearing against said web.

8. A structure as defined in claim 7, in combination with a shoe upper secured to said outer sole and having a moderator portion extending across and bearing against the upper portion of said sole member.

9. A structure as defined in claim 1, in combination with a shoe upper secured to the upper portion of said outer sole, said sole member being disposed in said shoe upper and bearing against said shoe upper.

10. A structure as defined in claim 1, in combination with a shoe upper secured to the upper portion of said outer sole, said sole member being disposed in said shoe upper and bearing against said shoe upper, and a moderator extending across said sole member and bearing against the upper side of said chambers.

11. A structure as defined in claim 1, in combination with a shoe upper secured to the upper portion of said outer sole, said sole member being disposed in said shoe upper and bearing against said shoe upper, and an elastomeric outer deformable member encapsulating the upper portion of said sole member.

12. The combination as defined in claim 1, said web having a thickness of about 0.020".

13. A structure as defined in claim 1; said studs being of multi-sided polygonal shape.

14. A structure as defined in claim 13, said studs being of substantially square shape in cross-section.

15. A structure as defined in claim 13; said studs being of substantially circular shape in cross-section.

16. A structure as defined in claim 2; said outer member being made of a polyurethane foam.

17. A structure as defined in claim 3; said outer member being made of a polyurethane foam.

* * * * *